United States Patent [19]

Yoshida et al.

[11] Patent Number: 4,663,245

[45] Date of Patent: May 5, 1987

[54] HOT-DIPPED GALVANIZED STEEL SHEET HAVING EXCELLENT BLACK TARNISH RESISTANCE AND PROCESS FOR PRODUCING THE SAME

[75] Inventors: Makoto Yoshida; Kazuhiro Tano; Seizun Higuchi; Masato Nakamura, all of Tokyo, Japan

[73] Assignee: Nippon Steel Corporation, Tokyo, Japan

[21] Appl. No.: 734,512

[22] Filed: May 16, 1985

[51] Int. Cl.[4] ..... B32B 15/04

[52] U.S. Cl. ..... 428/632; 428/659

[58] Field of Search ..... 428/659, 668, 678, 680, 428/632

[56] References Cited

U.S. PATENT DOCUMENTS 3,816,082 6/1974 Austin et al. ..... 428/659

4,500,610 2/1985 Gunn et al. ..... 428/632

FOREIGN PATENT DOCUMENTS 25992 2/1984 Japan ..... 428/659

*Primary Examiner*—L. Dewayne Rutledge

*Assistant Examiner*—Robert L. McDowell

*Attorney, Agent, or Firm*—Pollock, Vande Sande & Priddy

[57] ABSTRACT

A zinc- or zinc alloy-hot-dipped, unpainted steel sheet having excellent black tarnish resistance, which has a coating of Ni, Co or a combination thereof deposited in an amount of from 0.1 to 15 mg/m$^2$ on the zinc or zinc alloy plating layer of the sheet, and optionally a chromate layer on the deposited coating, is provided. The steel sheet is produced by immersing a zinc- or zinc alloy-hot-dipped steel sheet in an aqueous solution containing 1 to 20 g/l of Ni ions, Co ions or a combination thereof to deposit Ni, Co or a combination thereof in an amount of from 0.1 to 15 mg/m$^2$ on the zinc or zinc alloy plating layer of the sheet, optionally followed by chromating in the usual manner.

9 Claims, 1 Drawing Figure

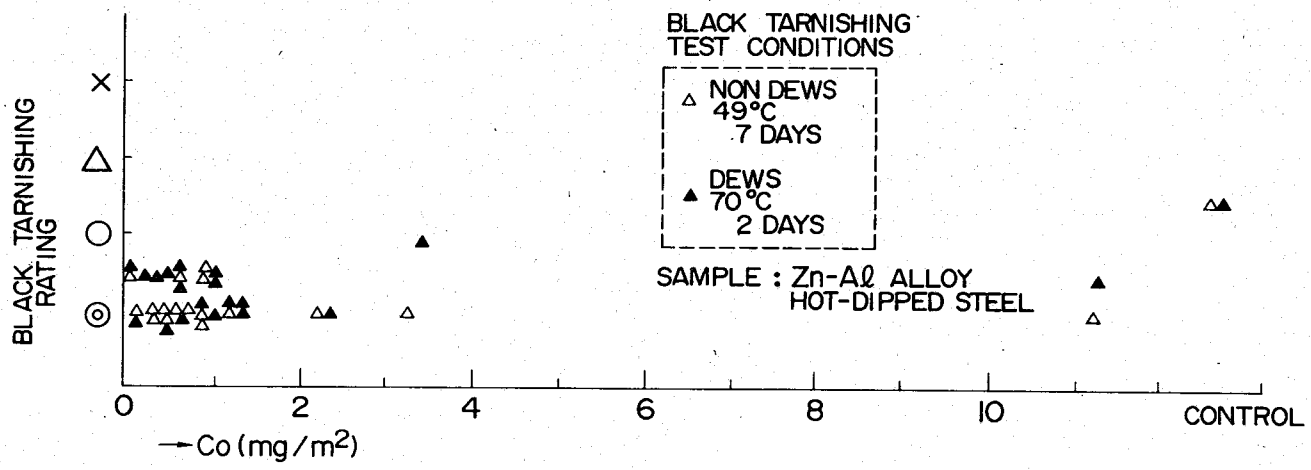
BLACK TARNISHING TEST CONDITIONS
NON DEWS 49°C 7 DAYS
DEWS 70°C 2 DAYS
SAMPLE : Zn-Aℓ ALLOY HOT-DIPPED STEEL
BLACK TARNISHING RATING
×
△
○
◎
0
2
4
6
8
10
CONTROL
Co (mg/m²)

HOT-DIPPED GALVANIZED STEEL SHEET HAVING EXCELLENT BLACK TARNISH RESISTANCE AND PROCESS FOR PRODUCING THE SAME

BACKGROUND OF THE INVENTION

The present invention relates to a zinc- or zinc alloy-hot-dipped, unpainted steel sheet having excellent black tarnish resistance and to a process for producing such steel sheets.

Recently, with the expanding demands and the diversification of applications, there are growing needs for further improvements of hot-dipped galvanized steel sheets in performance characteristics of, for example, appearance, workability, chemical treatability (treatability before painting), and corrosion resistance. For improving the workability and chemical treatability, the so-called "zero-spangle treatment" is practiced, which treatment is carried out by spraying atomized water against the surface of a molten zinc layer after hot dipping and before the solidification of the layer, to make fine zinc crystals. Further the treated sheet is subjected to skin-pass rolling (usually 1–3% draft) for improving the appearance or surface microscopic geometry (surface smoothness).

However, the skin-pass rolling, when followed by chromating for improving the corrosion resistance and organic coat adhesion, is often caused the trouble of discoloring the plating surface to blue-brown-black (hereinafter the discoloring is referred to as black tarnishing) during relatively short time storage or during transport.

For improving the corrosion resistance, techniques of alloying zinc by adding Al, Mg, Ti, or a rare earth element (La or Ce) to a molten Zn bath have been studied inside and outside this country and some of them were already put into practical operation.

However, when these zinc alloy-hot-dipped steel sheets were chromated, black tarnish was observed on the plating surface during storage or transport similarly in case of zero-spangle treated galvanized steel sheets (skin-pass sheets).

When these zinc alloy-hot-dipped steel sheets are skin-pass-rolled (draft 1–3%), black tarnish will appear thereon in shorter time. Also on usual hot-dipped galvanized steel sheets (non-skin-pass sheets), black tarnish due to the spangle is occasionally observed in spotty form during long-term storage, but the black tarnish on the above-mentioned zero-spangle treated skin-pass sheets and alloy plated sheets is characterized by developing for a very short period of time. In addition, the black tarnish is more liable to develop when these sheets are stored in stacked form after cutting into pieces or in coiled form than when these are left standing in bared form in a room. As regards the effect of environments, the black tarnish is liable to develop in high temperature and humidity surroundings.

The present inventors detected a thicker layer (estimated at hundreds-thousands Å) of zinc hydroxide-zinc carbonate mixture on the plating surface where black tarnish had developed than on the surface where black tarnish did not yet develop. From this result and the above information, the mechanism of the black tarnish development is presumed as follows: on the surface of the zinc alloy-hot-dipped steel sheet, Al or Mg added for alloying is present in the form of metal or oxide and forms local cells jointly with Zn, thereby causing the electrochemical corrosion (reaction of metallic zinc with moisture and chromic acid) to proceed abnormally quickly under corrosive environmental conditions mediated by the chromate coating layer which inherently contains moisture and is liable to absorb moisture. The black appearance of the plating surface may be contributed to by the light interference due to the presence of a thin zinc hydroxide-zinc carbonate layer on fine depressions and projections formed by the corrosion of the Zn layer.

The reason why the skin-pass-rolled sheet becomes liable to undergo black tarnishing is conceivably because strain and fresh Zn surfaces are produced in the plating layer by the rolling, which develops more chemically active local cells accelerating the corrosion. For the purpose of preventing the plating surface from being black tarnished, there has been proposed after-treatment with non-chromate chemicals, or zinc electroplating. For instance, a method of coating with a water-soluble resin has been proposed as the non-chromate after-treatment method. However, as can be assumed from the above-mentioned mechanism of black tarnish development, a thin resin coating cannot shut out the penetrating moisture, thus allowing the black tarnishing.

Recently, Japanese Patent Application Laid-Open No. 114695/82 discloses a process for producing galvanized steel sheets superior in resistance to black tarnishing and resistance to intergranular corrosion. This technique comprises plating steel sheets with zinc or a zinc alloy by hot dipping, and treating the plated sheets with an alkali metal carbonate solution, followed by electroplating the treated sheets with zinc. According to this patent application, it is said that oxides of Zn, Al, Fe, and Si formed on the hot-dipped galvanized surface are completely dissolved by the treatment with an alkali metal carbonate solution and this permits the black tarnishing and the intergranular corrosion to be prevented even when the subsequent zinc electroplating gave a thin film.

The above-mentioned technique, however, requires two additional operation steps of alkali cleaning and zinc electroplating, and thus high investment cost for equipment and complicated management of the plating bath being inevitable.

Other examples of prior art include the techniques disclosed in Japanese Patent Application Laid-Open No. 152834/77 entitled "Method for Pretreatment of Hot-Dip Galvanize Steel Sheet before Painting", Japanese Patent Application Laid-Open No. 115624/78 entitled "Method for Conditioning Galvanized Steel Sheet Surface", and Japanese Patent Publication No. 26434/83 entitled "Method for Zinc Surface Treatment". These known techniques, however, deal with only the adhesion of organic coating materials and the corrosion resistance of the coating, as problems to be solved. These Japanese Patent Application Laid-Open Nos. 152834/77 and 26434/83 disclose the method of removing the oxide film formed on galvanized steel sheets and dissolving the zinc surface at the same time, by means of a strong acid solution containing Co, Ni, or Fe metal ions, to substitute and deposit the metal. It is widely known that the surfaces of galvanized steel sheets when etched with an acid shows a white, gray, or black appearance according to spangle patterns. The etching followed by the metal substitution-deposition intensifies the black tarnish. The Japanese Patent Application Laid-Open No. 115642/78 discloses the method of simultaneously conducting the formation of a phosphate coat and the removal of the oxide film, dissolution of zinc, and substitution-deposition of a metal. This phosphate coat is similar in coating weight to those obtained by the usual phosphating, which are well known to exhibit a gray or gray-black color. Thus, steel sheets according to these three known methods each exhibits a color (gray, brown, or black) characteristic of the coat before chromating, in other words, black tarnishing of the sheets has already occurred before chromating. The subsequent chromating will add a yellow color to the above color, resulting in a gray-black-yellow mixed color. However, the three methods of the above-mentioned three Japanese documents do not intend to remove a color or avoid the black tarnishing since the sheets after chromating are painted.

SUMMARY OF THE INVENTION

Accordingly, the present inventors made intensive studies on treatment methods which will be simple in operation and effective in preventing the black tarnishing without requiring any expensive equipment, and as a result, have found out a method for the treatment of unpainted hot-dipped galvanized steel sheets with an aqueous solution containing Ni ions, Co ions or a combination thereof.

An object of the present invention is to provide unpainted hot-dipped galvanized steel sheets having metallic gloss, zinc metal color as such or slightly tinged with yellow even when the amount of metal deposited is large, and excellent resistance to black tarnishing.

Another object of the present invention is to provide a process for producing such hot-dipped galvanized steel sheets as stated above.

According to the present invention, a steel sheet plated by hot dipping with zinc or with a zinc alloy containing low concentrations of Al and Mg is immersed for a short period of time in a solution of Ni ions and/or Co ions or sprayed with this solution and, if necessary, is subjected to the usual chromating, thereby achieving a superior effect of preventing black tarnish.

BRIEF DESCRIPTION OF THE DRAWING

FIG. 1 is a graph showing the relation between the amount of Co deposited and the resistance to black tarnishing when a steel sheet hot dipped in a Zn-Al alloy was treated with a Co solution according the invention.

DETAILED DESCRIPTION OF THE INVENTION

The conditions of the process in accordance with the present invention are as follows: For the solution containing Ni ions, Co ions or a combination thereof, there may be used either an acidic bath containing a sulfate, chloride, nitrate, acetate or citrate of Ni, Co or a combination thereof, or an alkaline bath containing a complexing agent such as ammonia or an organic acid together with the above-mentioned Ni- and/or Co-salts. There are no particular limitations on the metal ion concentration in the bath and on the temperature and pH of the bath. These factors can be selected from wide ranges. But, the concentration of Ni ions, Co ions or a combination thereof is desirably in the range of 1 to 20 g/l. If the concentration is below 1 g/l, then a prolonged period of time for the treatment will be required, and if the concentration is higher than 20 g/l, then the quantity of the metal ions carried away by drag-out will be as large as economically unsatisfactory. The bath temperature is suitably from 30° to 60° C. If the temperature is below 30° C., then a prolonged period of time for the treatment will be required, and if the temperature exceeds 60° C., too much energy will be required for heating.

The pH value of the bath is suitably from 1 to 4 in case of the acidic bath, and from 11 to 13.5 in case of the alkaline bath. Outside this pH range an excessive or deficient amount of Ni, Co or a combination thereof will be deposited on the plating surface. According to elaborate experiments by the present inventors, the amount of Ni, Co or a combination thereof deposited on the plating surface is suitably from 0.1 to 15 $mg/m^2$, preferably from 0.3 to 3 $mg/m^2$. If the deposited amount is less than 0.1 $mg/m^2$, then the black tarnishing will be liable to occur during storage under so high temperature and humidity conditions as in summer. If the deposited amount is larger than 15 $mg/m^2$, the sheet will not only become slightly yellow or brown, losing the original metallic appearance, but also the bath will be much aged, this being also uneconomical.

With respect to this matter, the present inventors examined the relation between the Co amount deposited and the black tarnishing tendency. Tests for the black tarnishing tendency were conducted by using pieces of a Zn-Al alloy-hot-dipped steel sheet, treating the pieces, except that some of them were used as control pieces, with the Co solution according to the invention, subjecting all the pieces to chromating, and exposing portions of the Co solution-treated pieces and of the control pieces in a dewing state at 49° C.—more than 98% relative humidity for 7 days after not giving dews on their surface and the other portions of the pieces in a non-dewing state at 70° C.—more than 98% relative humidity for 2 days after giving dews on their surface, thereby observing the degree of black tarnishing on each piece. Results of the observation are shown in FIG. 1, wherein the data are plotted with the Co amount deposited for abscissa and with the degree of black tarnishing (rating of black tarnish hesistance) for ordinate. The meaning of the rating marks are as follows:

. . . Not tarnished

. . . Very slightly turned gray

Δ . . . Less than 30% of the whole area turned black

X . . . 30% or more of the whole area turned black.

FIG. 1 indicates that the sheet treated with the Co solution according to the invention is superior to the untreated sheet in black tarnish resistance.

The period of immersion or spraying for this treatment is suitably chosen so that the Co amount deposited becomes from 0.1 to 15 $mg/m^2$, depending upon the above-stated concentration, temperature, and pH. According to the present inventors' experiments, the period of time for the treatment can be chosen as desired from the wide range of 0.3 to 10 seconds.

The mechanism of preventing the black tarnishing according to the invention is presumed as follows: When the zero-spangle zinc-galvanized steel sheet (skin-pass sheet) or zinc alloy-galvanized steel sheet which is subject to black tarnishing is immersed in a Co- and/or Ni-containing solution, the Ni and/or Co will be deposited in metallic or oxide form on the active sites (electrochemically, anodic sites) of a plated surface, thereby depressing the activity. As a result, the progress of the corrosion based on local cells will be prevented.

The treatments with solutions containing Fe, Mn, Sn and/or Cu ions were investigated, besides the treatment according to the invention, but with the result that the sheets treated with the Sn ion-containing solution and with the Cu ion-containing solution, respectively, became more subject to black tarnishing though the respective treatments with the Fe ion-containing solution and with the Mn ion-containing solution were found to be slightly effective.

Other advantages of the treatment method according to the present invention are that the equipment is simple because of the immersion or spray treatment, that the management of the treating solution is easy, that the treatment is effective with a trace amount of Ni, Co or a combination thereof deposited, and, hence, that the treatment can be accomplished at a low cost.

The present invention is illustrated in more detail with reference to the following examples.

EXAMPLE 1

A zero-spangle galvanized steel sheet produced in a known continuous hot-dip galvanizing line was skin-pass rolled, and cut into specimens. These specimens, except for those used as controls, were treated according to the present invention under various conditions. Then, the treated specimens and control specimens were subjected to accelerated corrosion tests to examine the black tarnish resistance.

Conditions of the treatments and tests and the criterion of the black tarnish resistance were as follows:

| | | |
|---|---|---|
| (i) | Specimen | |
| | Size: | 0.5 × 100 × 200 mm (not chromated) |
| | Amount of Zinc plating: | 150 g/m$^2$ |
| | Draft in skin-pass rolling: | 1% |
| (ii) | Pretreatment (treatment according to the present invention) | |
| | (a) Not treated | |
| | (b) Ni treatment: (acidic bath) | $NiSO_4.6H_2O$ 50 g/l, pH 2, at 50° C., immersion for 2 sec. |
| | (c) Co treatment: | $CoSO_4.7H_2O$ 50 g/l, pH 2, at 50° C., immersion for 0.5 sec. |
| | (d) Co treatment: (alkaline bath) | $CoSO_4.7H_2O$ 50 g/l, citric acid 15 g/l, NaOH 40 g/l, pH 13.2, at 60° C., immersion for 2 sec. |
| | (e) Ni + Co treatment | $NiSO_4.6H_2O$ 25 g/l, $CoSO_4.7H_2O$ 25 g/l, pH 2, at 50° C., immersion for 1 sec. |
| | (f) The same as (b), except for immersion for 10 sec. | |
| | (g) The same as (c), except for immersion for 6 sec. | |
| (iii) | Washing: | City water |
| (iv) | Chromating: | $CrO_3$ 30 g/l, at 50° C., immersion for 5 sec. |
| (v) | Accelerated test for black tarnish | |
| | (1) Sample size: | 100 × 100 mm, 5 stacked sheets packed with wrapping paper |
| | (2) Atmosphere and standing time: | A 49° C., 98% RH, 7 days<br>B 70° C., 98% RH, 3 days |
| | (3) Criterion of resistance to black tarnishing: | Rating marks have the same meaning as described above. |

Results of the tests are shown in Table 2.

As is seen Table 2, the specimens treated according to the present invention have excellent black tarnish resistance. Similarly treated sheets stored in coil form for one year did not undergo black tarnishing.

TABLE 1

Results of accelerated black tarnish tests (Example 1)

| Sample | Pretreatment method | Coating weight (one side) Co and/or Ni (mg/m$^2$) | Coating weight (one side) Cr (mg/m$^2$) | Evaluation of black tarnish resistance A 49° C., 7 days | Evaluation of black tarnish resistance B 70° C. 3 days |
|---|---|---|---|---|---|
| a | not treated | 0 | 9 | X | X |
| b | Ni treatment | 2.8 | 11 | | |
| c | Co treatment (acidic bath) | 1.7 | 8 | | |
| d | Co treatment (alkaline bath) | 2.1 | 9 | | |
| e | Ni + Co treatment | Ni 1.5<br>Co 0.7 | 9 | | |
| f | Ni treatment | 13 | 13 | | |
| g | Co treatment (acidic bath) | 8.5 | 11 | | |

EXAMPLE 2

A steel sheet was plated with a Zn-Al (4%)-Mg (0.3%) alloy in a known continuous hot-dip galvanizing line, and cut into specimens. These specimens, except for those used as controls, were treated according to the present invention under various conditions. The treated specimens and control specimens were subjected to accelerated corrosion tests to examine the black tarnish resistance.

Conditions of the treatments and tests and the criterion of the black tarnish resistance were the same as in Example 1, but the specimens were as follows:

| (i) Specimen | |
|---|---|
| Size: | 0.5 × 100 × 200 mm (not chromated) |
| Amount of zinc plating: | 120 g/m$^2$ |
| Skin-pass rolling: | Not rolled |

Results of the tests are shown in Table 2.

Therefrom it proves that all the specimens treated according to the present invention have excellent black tarnish resistance. Similarly treated sheets stored in coil form for one year did not undergo black tarnishing.

TABLE 2

Results of accelerated black tarnish tests (Example 2)

| Sample | Pretreatment method | Coating weight (one side) Co and/or Ni (mg/m$^2$) | Coating weight (one side) Cr (mg/m$^2$) | Evaluation of black tarnish resistance A 49° C. 7 days | Evaluation of black tarnish resistance B 70° C. 3 days |
|---|---|---|---|---|---|
| a | Not treated | 0 | 13 | X | X |
| b | Ni treatment | 2.2 | 10 | | |
| c | Co treatment (acidic bath) | 2.1 | 9 | | |
| d | Co treatment (alkaline bath) | 1.6 | 11 | | |
| e | Ni + Co treatment | Ni 0.8<br>Co 0.5 | 8 | | |
| f | Ni treatment | 12.5 | 14 | | |
| g | Co treatment (acidic bath) | 7.3 | 14 | | |

What is claimed is:

1. A zinc- or zinc alloy-hot-dipped, unpainted steel sheet having excellent black tarnish resistance, which has a coating consisting essentially of Ni, Co or a combination thereof deposited in an amount of from 0.1 to 15 mg/m$^2$ on the zinc or zinc alloy plating layer of the sheet.

2. The steel sheet of claim 1, wherein the amount of the coating deposited is from 0.3 to 3 mg/m$^2$.

3. The steel sheet of claim 1 wherein said coating consists of Ni, Co, or a combination thereof.

4. The steel sheet of claim 1 wherein said coating includes Ni.

5. The steel sheet of claim 1 wherein said coating includes Co.

6. The steel sheet of claim 1 wherein said coating includes a combination of Ni and Co.

7. A zinc- or zinc alloy-hot-dipped, unpainted steel sheet having excellent black tarnish resistance, which has a coating consisting essentially of Ni, Co or a combination thereof deposited in an amount of from 0.1 to 15 mg/m$^2$ on the zinc or zinc alloy plating layer of the sheet and a chromate layer on the deposited coating.

8. The steel sheet of claim 7 wherein the amount of said deposited coating is from 0.3 to 3 mg/m$^2$.

9. The steel sheet of claim 8 wherein said coating consists of Ni, Co, or a combination thereof.

* * * * *